US005246067A

United States Patent [19]

Heinonen et al.

[11] Patent Number: 5,246,067

[45] Date of Patent: Sep. 21, 1993

[54] WELL LEAK CATCHER

[75] Inventors: Robert L. Heinonen; James A. Wilson, both of Dallas; Eric R. Cassidy, Plano, all of Tex.

[73] Assignee: Double-E Inc., Dallas, Tex.

[21] Appl. No.: 871,483

[22] Filed: Apr. 21, 1992

[51] Int. Cl.[5] ..... E21B 33/08

[52] U.S. Cl. ..... 166/81; 166/84; 73/40

[58] Field of Search ..... 166/81, 82, 84, 86, 166/87, 88, 95; 73/40

[56] References Cited

U.S. PATENT DOCUMENTS

| | | | |
|---|---|---|---|
| 4,665,976 | 5/1987 | Retherford | 166/84 X |
| 4,907,650 | 3/1990 | Heinonen | 166/80 |
| 5,148,699 | 9/1992 | Morse | 73/40 |
| 5,150,751 | 9/1992 | Burton et al. | 166/81 |

OTHER PUBLICATIONS

Barton Industries, Inc., Bartech Stuffing Box Leak Detection System Product Sheet (2 pages) Date: Prior to Mar. 1991.

Double-E, Inc, Leak Sensor Product Sheet (1 page) Date: Prior to 1991.

*Primary Examiner*—William P. Neuder

*Attorney, Agent, or Firm*—Johnson & Gibbs

[57] ABSTRACT

A leak catcher for use on a pumping well around a polished rod operating a downhole pump in the well including an annular drip bowl connected with a base securable to the upper end of a well casing around a polished rod, a drain line fitting opening into a side of the drip bowl, a leak collection well formed in the bottom of the drip bowl, a horizontal liquid level switch mounted to a side of the liquid collection well, a drain valve mounted horizontally through a side of the liquid collection well, a removable hood securable to the drip bowl, and a polished rod lubricator assembly secured in the top of the hood around a polished rod. The hood may be either a solid cylindrical member formed of opaque metal or transparent plastic or may include hinged doors for access into the leak catcher without removal of the hood. The leak catcher is constructed in the modular form so that the drip bowl with the liquid level switch and drain fittings may be used alone or in conjunction with the hood and lubricator assembly. The catcher may also include a stuffing box with a remotely controllable emergency seal assembly and a flapper valve for closing the bore through the leak catcher if a polished rod through the catcher breaks.

19 Claims, 1 Drawing Sheet

WELL LEAK CATCHER

This invention relates to well pumping apparatus and more particularly relates to devices for detecting and catching leaks from pumping oil wells and the like.

BACKGROUND OF THE INVENTION

Wells, particularly oil wells, penetrating oil producing earth formations which do not have adequate pressure for flowing the wells must be produced by a variety of systems including downhole well pumps operated by a polished rod which passes through a stuffing box located at the surface. The purpose of the stuffing box is to seal around the reciprocating polished rod to prevent leakage resulting in both the loss of expensive well fluids and also contaminating the earth surrounding the well. Various types of apparatus have been proposed and are available to detect and contain fluids leaking from a well around a polished rod. One such system is manufactured by Double-E Inc., Dallas, Tex., which includes two pots mounted at the side of and connected with a stuffing box by short pipe sections. One of the pots contains lubricating oil which flows by way of a wick to a seal around the polished rod in the mounting for the pots. The other pot collects leaking fluids and includes a level switch which may be connected to perform multiple functions including shutting down the pumping unit, automatically packing off around the polished rod, and activating a warning signal. Another known form of leak detection system includes a clamshell type housing fitting around a stuffing box and sealing with the polished rod. A drain line and valve and liquid level probe are provided in the system which may be connected to shut the pump motor down and to provide visible or audible alarms signaling the leak. Servicing of a stuffing box within such a clamshell leak detection system and servicing of the system itself requires complete removal of the clamshell housing from the stuffing box which can create contamination around the well and require additional means for containing a leak during repair.

SUMMARY OF THE INVENTION

It is a principal object of the invention to provide a new and improved system for detecting and containing leaks from pumping wells.

It is another object of the invention to provide a new and improved leak catcher for detecting and containing leaks from stuffing boxes around polished rods on pumping oil wells and the like.

It is another object of the invention to provide a leak catcher of the character described which includes a liquid collection well and a horizontal level switch and a horizontal liquid drain valve connected in the well to minimize the height of the leak catcher.

It is another object of the invention to provide a leak catcher of the character described which includes a polished rod lubrication system.

It is another object of the invention to provide a leak catcher of the character described which includes apparatus for effecting a supplementary seal around a polished rod operable responsive to detection of a leak or activated by a sealed pressure medium in the system providing a full time supplementary seal around the polished rod.

It is another object of the invention to provide a leak catcher of the character described which includes an emergency flapper valve which closes if the polished rod breaks.

It is another object of the invention to provide a leak catcher of the character described which is modular, comprising several components including a leak bowl which will detect and contain a leak and a removable hood which may be formed in one piece component or with hinged doors to provide access to a stuffing box within the hood.

In accordance with the invention, there is provided a leak catcher for detecting and containing leaks in a stuffing box around a polished rod including a drip bowl for connection with a stuffing box around a polished rod, the bowl having a well for collection of leaking liquids, a horizontal level switch connected with the bowl extending into the well and operable responsive to the liquid level in the well, a horizontal drain valve connected into the well, and a removable hood for mounting on the drip bowl around a polished rod including an annular seal for sealing with the polished rod. The removable hood may be formed of solid or transparent material and may include hinged doors. The leak catcher may also include any one or all of a polished rod lubrication system having an oil reservoir and a wick for flowing oil to the polished rod surface, a flapper valve for emergency closure in the event of polished rod breakage, and a stuffing box having a supplementary pressure activated seal system for sealing with the polished rod in response to leak detection or permanently activated by a sealed pressure medium.

BRIEF DESCRIPTION OF THE DRAWINGS

The details of specific embodiments of the invention and the foregoing objects and advantages will be better understood from the following description taken in conjunction with the accompanying drawings wherein.

DETAILED DESCRIPTION OF THE PREFERRED EMBODIMENT

Figures 1, 2, 3, 4:
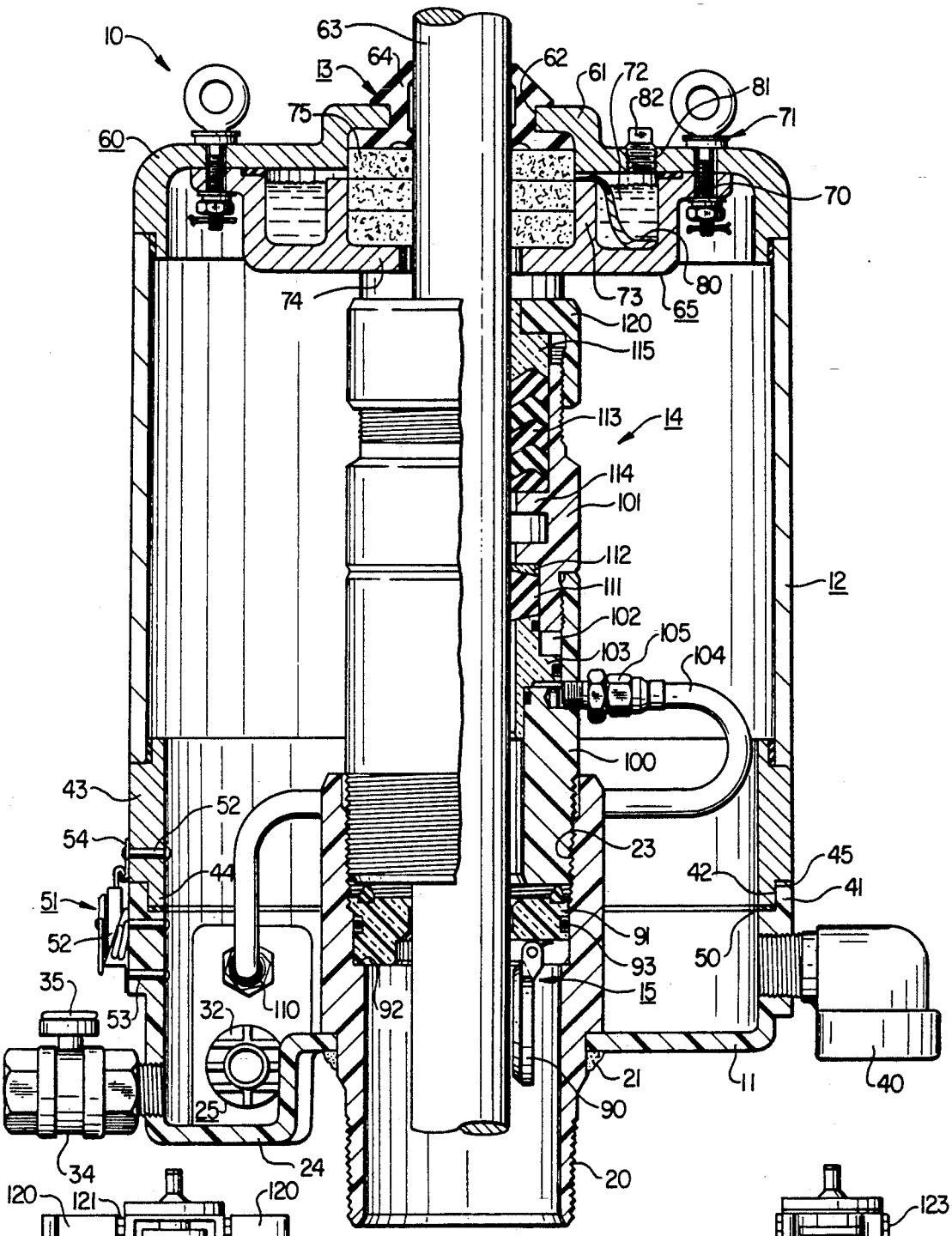
FIG. 1 is a side view in elevation and section of a preferred embodiment of the leak catcher of the invention.
FIG. 2 is a schematic fragmentary side view in elevation of a form of the leak catcher employing an opaque hood with hinged doors for access to the interior of the catcher while mounted on a stuffing box.
FIG. 3 is another form of the leak catcher of the invention using a transparent hood and hinged transparent access doors.
FIG. 4 is a schematic side view of a liquid level switch used in the leak catcher illustrating the switch in an open position in phantom lines.

Referring to the drawings, a leak catcher 10 has a cylindrical housing including a reservoir or drip bowl and a removable hood 12. A polished rod lubricator assembly 13 is secured in the top of the hood 12. A stuffing box 14 and a flapper valve assembly 15 are mounted in the hood on the drip bowl. In accordance with the modular concept of the invention, the drip bowl may be used alone or in conjunction with the hood 12 and lubricator assembly 13. Further, either or both the stuffing box 14 and the flapper valve assembly 15 may also be used in conjunction with the drip bowl and hood as illustrated in FIG. 1.

Referring to FIG. 1, a base 20 is secured in concentric relation in the drip bowl 11 and welded to the bowl at 21. The base is externally threaded at 22 for securing to a well casing, not shown. The base is also internally threaded at 23 for connection of the stuffing box 14 into the base.

As shown at the lower left portion of FIG. 1, the bottom of the drip bowl 11 is formed with a downwardly extending leak detection well 24 in which the first liquid to leak into the leak catcher will flow and collect. A liquid level switch 25 is horizontally mounted in the back side of the well 24 as illustrated in FIG. 1 to sense liquid collecting in the well. The liquid level switch 25 is a standard, single-station switch activated by the liquid level in the well 24 and includes a switch portion 30 and a float switch actuator 31 shown in solid lines in a switch-closed position and in phantom lines in a switch-open position. The switch is mounted in a pipe fitting 32 secured through the back side of the well 24 as shown in FIG. 1. Conductor wires 33 lead through the pipe fitting to the switch for connection with a remote motor controller, not shown, so that when leaking liquid in the well 24 raises the switch to the closed position a signal through the wires 33 will operate the controller to shut off the pump motor. A ball valve 34 having an operator knob 35 is connected into the side of the well 24 as seen in FIG. 1 to drain liquid from the well 24. As shown at the right lower corner of FIG. 1, a pipe fitting 40 is secured into the bottom portion of the drip bowl 11 for connection with a drain line, not shown, for draining leaking liquid from the drip bowl. The upper edge of the drip bowl 1 is shaped to define an upwardly extending flange 41 and an internal annular recess 42 for mounting the removable hood 12 on the drip bowl.

The removable hood 12 includes a base ring 43 having a lower end edge shaped with an internal flange 44 and an external annular recess 45 which mate with the upper edge of the drip bowl for mounting the hood on the drip bowl. An annular gasket 50 fits between the lower end edge of the base ring flange 44 and the bottom of the drip bowl mounting recess 42 as shown in FIG. 1. The hood is releasably connected on the drip bowl by circumferentially spaced fasteners 51. In one particular embodiment of the leak catcher, three fasteners at 120 degree spacing were used. Each of the fasteners 51 includes a spring loaded latch assembly 52 secured by brads 53 around the drip bowl and latch hooks 54 secured by brads 55 to the hood base ring 43. As seen in FIG. 1, each of the fastener latch assemblies and the latch hooks latch together to hold the hood on the drip bowl. One form of fastener 51 which has been used is a standard available component sold by Simmons Fastener Company, Albany, N.Y., under the trademark "3-10 LINK-LOCK".

As shown in FIG. 1, an annular head 60 is mounted on the hood 12 including an integral upwardly extending central flange 61 having a central opening 62 for receiving a polished rod 63 which extends upwardly to a pump operator, not shown, and downwardly to a downhole pump, not shown. An annular seal 64 is mounted in the hood head opening 62 on the flange 61 for sealing in the opening around the polished rod. An annular polished rod lubricator reservoir plate 65 is mounted on the bottom face of the head 60 around the polished rod. The plate 65 has an upper end external annular flange 70 connected with the bottom face of the head 60 by circumferentially spaced eye screw assemblies 71. The reservoir plate 65 has an annular reservoir 72 defined between the outer rim of the reservoir plate and an internal upwardly extending flange 73 of the reservoir plate. The reservoir plate 65 also has an internal annular lower end flange 74 which supports a stack of annular lubricator pads 75. A wick 80 extends from the lubricator pads 75 downwardly into the lubricator reservoir 72 for flow of a lubricating liquid such as oil by capillary attraction from the reservoir 72 to the lubricator pads 75. A fill port 8 is provided in the head 60 opening into the lubricator reservoir 72 to supply lubricating liquid into the reservoir. The fill port is closed by a threaded plug 82.

In accordance with the modular design of the leak catcher of the invention, the flapper valve assembly 15 may be installed in the base 20 of the drill bowl 11 for emergency closure of the bore through the base in the event that the polished rod 63 breaks and falls into a well below the leak catcher. The flapper valve assembly has a spring loaded flapper valve 90 mounted on the bottom face of a flapper valve seat 91 which is an annular member supported in the base 20 on an internal annular flange 92. An O-ring seal 93 seals between the seat 91 and the internal bore surface of the base 20. Details of construction and operation of similar flapper valves are shown in U.S. Pat. No. 4,907,650, issued Mar. 13, 1990, to Robert L. Heinonen and assigned to Double-E Inc., Dallas, Tex.

Further, in accordance with the modular design of the leak catcher of the invention, the stuffing box 14 may form a component of the leak catcher. The stuffing box has a lower body section 100 threaded into the leak catcher base 20 and an upper body section 101 threaded into the lower body section. An annular cylinder 102 is defined in the stuffing box body between the lower and upper body sections. An annular piston 103 is mounted in the cylinder 102 for upward movement responsive to fluid pressure conducted into the cylinder below the piston through conduit 104 secured into the cylinder by fitting 105. The conduit 104 extends downwardly around the base 20 into the leak bowl 11 where the opposite end of the conduit is connected with another fitting 110 through a backside of the drip bowl as seen in FIG. 1. The fitting 110 may be connected with a source of pressure, not shown, as discussed hereinafter. An expandable packing ring 111 is mounted in the upper body section 101 on the top of the annular piston 103 between the piston and a retainer ring 112. Upward movement of the annular piston 103 will expand the ring 111 to seal off in the stuffing box body section 101 around the polished rod. An annular seal assembly 113 is mounted in the upper body section 101 of the stuffing box around the polished rod held on an internal annular flange 114 of the upper body section. An annular bushing 115 is held by a retainer cap 120 on the upper body section holding the seal assembly 113 in place in the upper body section 101.

The hood 12 is illustrated in FIG. 1 as a solid cylindrical member which may be formed of an opaque metal such as aluminum or of a clear plastic material for easy sight into the leak catcher. Alternatively, as shown in FIG. 2, the hood may be provided with opaque doors 120 mounted on hinges 121 in the hood for ready access into the interior of the leak catcher. A still further form of the leak catcher includes clear plastic doors 122 mounted on hinges 123 in the hood as illustrated in FIG. 3.

In the operation of the leak catcher, in accordance with the invention, the modular design permits the operator of a well to elect several combinations of the components disclosed and illustrated. For example, if the well operator desires to use an existing standard stuffing box, the minimum component of the invention selected may be the drip bowl 11 with the base 20 including the liquid level switch 25, the ball valve 34, and the drain line fitting 40. Under such circumstances, the base 20 is connected with the casing of the existing well, not shown, and the existing stuffing box is connected into the threads 23 at the upper end portion of the base 20. The wires 33 from the liquid level switch 25 are connected with a suitable alarm or a well pump control, not shown, to either alert the operator or to shut down the system in the event that a leak occurs in the stuffing box around the polished rod 63. The leaking liquid flows into the drip bowl 11 to the collection well 24, and as the liquid level in the well 24 builds up, the float 31 of the switch is raised to the closed solid line position of FIG. 4 completing the circuit in which the wires 33 are connected to alert the operator that a leak has occurred and liquid has built up in the well 24, or alternatively, if the system permits, to shut the system down. The pipe fitting 40 may lead to a line to a barrel or sump for collection of the leaking liquid.

If the well operator desires, the leak catcher of the invention may include the hood 12 with or without the polished rod lubricator assembly 13. The hood may be selected as a solid metal opaque hood or a clear plastic hood. The hood also may include hinged doors 120 of the opaque material or the clear plastic hinged doors 122, as shown in FIGS. 2 and 3. The hood is secured on the drip bowl 11 by the fasteners 51 which are operable to latch the base ring 43 of the hood into the drip bowl 11 as illustrated in FIG. 1. Also, the polished rod lubricator assembly 13 may be included in the hood mounted as shown in FIG. 1 around the polished rod 63. Lubricating oil in the reservoir 72 introduced through the port 81 in the head 60 of the hood is contained in the reservoir 72 of the reservoir plates 65. Capillary attraction through the wick 80 conducts the lubricating liquid from the reservoir to the lubricator pads 75 around the polished rod. So long as the height of the existing stuffing box may be contained within the hood below the lubricator reservoir plate 65, an existing stuffing box may be used with the hood 12 and the lubricator assembly 13 as illustrated in FIG. 1.

If the well operator elects to install the entire component combination illustrated in FIG. 1, the stuffing box 14 is installed at threads 23 in the upper end of drip bowl base 20 as shown. The fitting 110 at the lower end of the conduit 104 is connected with a pressure medium such as oil or grease which is injected into the annular cylinder 102 below the piston 103 to squeeze and expand the annular seal 111 around the polished rod 63 sealing with the rod in the stuffing box. Alternatively, the fitting 110 may be connected with a pressure source controlled by the float switch 25 so that the pressure is raised in the conduit 104 when the stuffing box leaks into the well 24 to cause the expandable seal 11 to respond to a leak in the stuffing box.

If installation of the flapper valve assembly 15 is elected, the assembly is installed in the base 20 below the stuffing box 14. With the flapper valve in place, the valve is biased towards a closed position being held open by the polished rod 63 passing through the valve. If the polished rod breaks and falls into the well below the flapper valve, the spring loaded flapper valve will close shutting off the bore through the stuffing box.

Whichever combination of components is used by the well operator, after a leak occurs and the well is to be restored to normal operation, the ball valve 34 is opened by the operator 35 to drain off the leaked liquid from the well 24 so that the float 31 of the liquid level switch 25 may drop back down to the open position illustrated in phantom lines in FIG. 4.

In addition to the advantages of the modular design of the leak catcher of the invention, the removability of the hood 12 by release of the fasteners 51 or the opening of the doors 120 or 122, if the door embodiment of the catcher is used, permits ready access to the interior of the leak catcher while leaving the drip bowl in place to contain and drain off a leak while the unit is serviced. A very versatile and very serviceable apparatus for detecting and controlling leaks at pumping well heads has thus been described and illustrated.

What is claimed is:

1. A leak catcher for detecting and controlling liquid leaks from a stuffing box of a pumping well comprising:

a drip bowl having a liquid collection well formed in and opening upwardly into portion of the bottom thereof;

b. a tubular base secured through a central portion and along an axis of said drip bowl for connection of said bowl to an upper end of a well conduit and for connection of a polished rod stuffing box into said tubular base;

c. a drain line fitting connected into a side of said drip bowl at a level above said liquid collection well of said drip bowl;

d. a liquid level switch in said liquid collection well to detect collection of liquid in said well at the level of said switch; and e. a drain valve connected into said liquid collection well for lowering the level of leaked fluid in said well below said level switch.

2. A leak catcher in accordance with claim 1 wherein said level switch is mounted in a side of said liquid collection well extending horizontally into said well.

3. A leak catcher in accordance with claim 2 where said drain valve is connected into a side of said liquid collection well.

4. A leak catcher in accordance with claim 1 including a removable cylindrical hood adapted to be mounted on said drip bowl around a polished rod and said stuffing box.

5. A leak catcher in accordance with claim 4 wherein said hood is a closed cylinder.

6. A leak catcher in accordance with claim 5 wherein said closed cylinder is formed of a solid metal material.

7. A leak catcher in accordance with claim 5 wherein said hood is formed of a transparent plastic material.

8. A leak catcher in accordance with claim 4 wherein said hood is formed of a metal material and includes hinged access doors.

9. A leak catcher in accordance with claim 4 wherein said hood is formed of a transparent plastic material and includes hinged access doors.

10. A leak catcher in accordance with claim 3 including a removable hood adapted to be mounted on said drip bowl, said hood being selected from the class consisting of a solid metal cylinder, a metal cylinder including hinged access doors, a solid transparent plastic cylinder, and a transparent plastic cylinder including hinged access doors.

11. A leak catcher in accordance with claim 3 including a removable hood for enclosing said stuffing box mounted on said tubular base and an annular lubricator assembly secured to the top of said hood around a polished rod above said stuffing box mounted on said tubular base, said lubricator assembly including a lubricator pad for engaging the surface of a polished rod, a liquid lubricator reservoir, and a wick from said reservoir to said pad to conduct lubricating liquid to said pad from said reservoir.

12. A leak catcher in accordance with claim 11 wherein said hood is selected from the class consisting of a solid metal hood, a transparent plastic hood, a solid metal hood having hinged access doors, and a transparent plastic hood including access doors.

13. A leak catcher in accordance with claim 12 including an emergency flapper valve assembly secured in said tubular base.

14. A leak catcher in accordance with claim 13 including said stuffing box secured with said tubular base above said flapper valve assembly within said hood below said lubricator assembly.

15. A leak catcher in accordance with claim 14 wherein said stuffing box includes a fluid pressure operated expandable seal for sealing within said stuffing box around a polished rod responsive to a fluid pressure applied to said annular cylinder.

16. A leak catcher in accordance with claim 3 including an emergency flapper valve assembly secured in said tubular base.

17. A leak catcher in accordance with claim 14 wherein said stuffing box includes a pressure fluid operable seal assembly including an annular piston and an expandable ring seal operable by said piston, said piston being movable responsive to a fluid pressure applied to said piston.

18. A leak catcher in accordance with claim 17 where said annular piston is operable responsive to a change in well conditions effecting an increase in fluid pressure applied to said annular piston.

19. A leak catcher in accordance with claim 10 wherein said removable hood is attachable to said drip bowl by fastener assemblies circumferentially spaced around said drip bowl and hood including spring loaded latch assemblies secured around said drip bowl and hooks secured around said hood positioned for engagement by said latch assemblies for removably holding said hood on said drip bowl.

* * * * *

UNITED STATES PATENT AND TRADEMARK OFFICE

CERTIFICATE OF CORRECTION

PATENT NO. : 5,246,067

DATED : September 21, 1993

INVENTOR(S) : Robert L. Heinonen, James A. Wilson, Eric R. Cassidy

It is certified that error appears in the above-indentified patent and that said Letters Patent is hereby corrected as shown below:

| | |
|---|---|
| Column 2, line 54: | Insert "11" after "drip bowl" |
| Column 2, line 60: | Insert "11" after "bowl" |
| Column 3, line 28: | Delete "1"; insert "11" |
| Column 4, line 5: | Delete "8"; insert "81" |
| Column 5, line 55: | Delete "11"; insert "111" |

Signed and Sealed this

Thirty-first Day of May, 1994

Bruce Lehman

*Attest:*

BRUCE LEHMAN

*Attesting Officer*

*Commissioner of Patents and Trademarks*